United States Patent [19]

Domagalski

[11] 4,402,159

[45] Sep. 6, 1983

[54] TRAFFIC DOOR

[75] Inventor: James A. Domagalski, Cascade, Wis.

[73] Assignee: Kelley Company, Inc., Milwaukee, Wis.

[21] Appl. No.: 238,119

[22] Filed: Feb. 25, 1981

[51] Int. Cl.[3] ..... E01F 13/00

[52] U.S. Cl. ..... 49/9; 49/34; 160/327

[58] Field of Search ..... 49/9, 34; 160/327, 354

[56] References Cited

U.S. PATENT DOCUMENTS

| | | | |
|---|---|---|---|
| 2,642,164 | 6/1953 | McLean | 49/9 |
| 3,295,589 | 1/1967 | Pfleger et al. | 160/327 |
| 4,064,924 | 12/1977 | Catlett | 49/9 X |

*Primary Examiner*—Kenneth Downey

*Attorney, Agent, or Firm*—Andrus, Sceales, Starke & Sawall

[57] ABSTRACT

A traffic door biased to the closed position and adapted to be swung to the open position when pushed manually or engaged by material handling equipment. The door includes an inverted L-shaped frame and a spring loaded cam mechanism is associated with the upper horizontal frame section of the frame and acts to bias the door to the closed position. The door is pre-hung on a vertical rail which is offset from the plane of the door. At the time of installation, the rail is plumbed and secured to the doorway jamb. The pre-assembled unit facilitates proper installation of the door, and the offset rail eliminates the need for rubber flaps to seal the gap between the door and the jamb. The traffic door assembly also includes an upper trim panel attached to the horizontal frame section which can be trimmed to size to fit the doorway.

14 Claims, 6 Drawing Figures

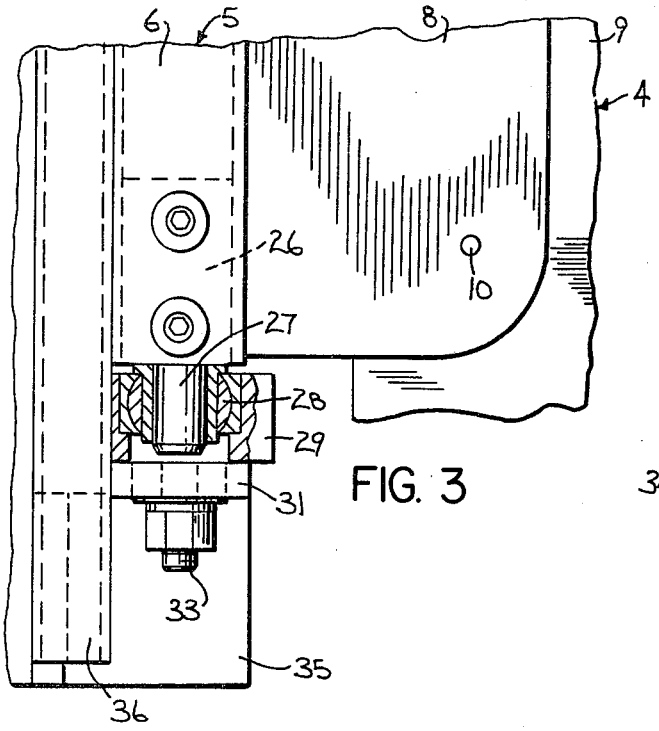
FIG. 3
FIG. 4
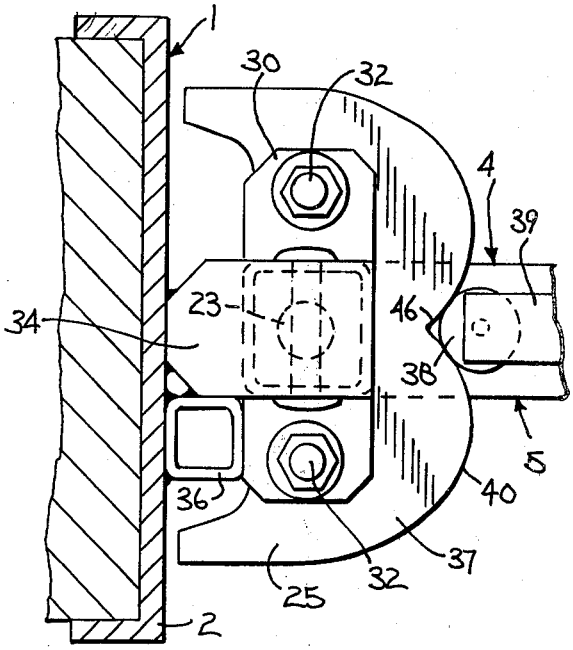
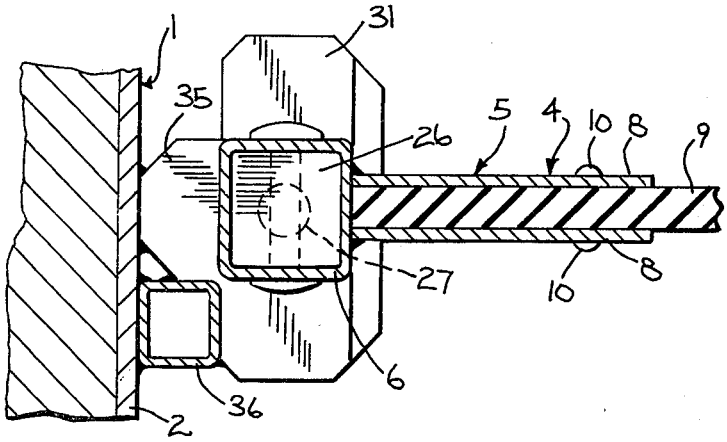
FIG. 5
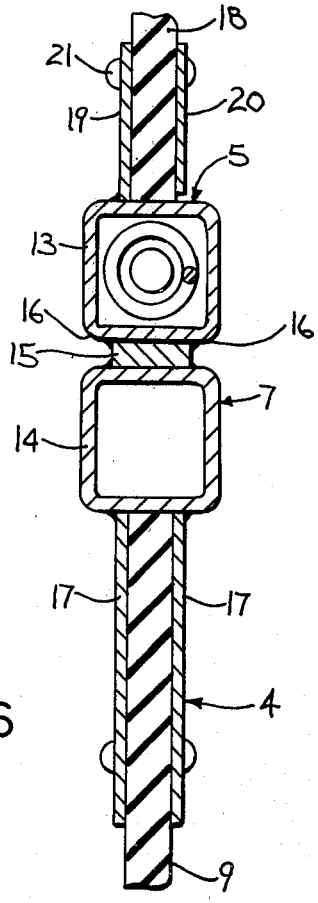
FIG. 6

TRAFFIC DOOR

BACKGROUND OF THE INVENTION

Traffic doors are two-way swinging doors commonly used in industrial and commercial establishments. The doors are normally biased to the closed position and can be swung to the open position manually or by impact with material handling equipment, such as a fork lift truck.

Traffic doors of the type shown in U.S. Pat. Nos. 3,295,589 and 4,060,924 include an inverted L-shaped frame which is hinged to the jamb of the doorway to swing in either direction, and the frame carries an impact resistant panel which can be engaged by material handling equipment to move the door to the open position. A spring loaded cam mechanism is associated with the upper horizontal section of the frame and acts to bias the door to the closed position. When the panel is engaged by material handling equipment, the door is swung to the open position against the force of the spring loaded cam mechanism, and after the equipment has passed through the doorway, the door is automatically returned to the closed position by the spring biasing force.

In the past, the installation of traffic doors has presented serious problems. As the traffic door is composed of an inverted L-shaped frame and a flexible rubber-like panel, it is not self-supporting. Because of this and the fact that the door has substantial weight, it has been necessary in the past to devise on-site equipment which would hold the door in an upright position as it is being installed in the doorway.

Problems have also arisen in properly aligning the doors within the doorway, particularly where a pair of swinging doors are to be employed. In commercial or industrial establishments, the doorway jamb is normally constructed of a steel channel, and in the conventional manner of hanging the traffic door, brackets are welded at upper and lower locations to the steel jamb and bearing assemblies are then mounted on the brackets. It is necessary to precisely align the bearing brackets at the upper and lower locations on the jamb in order that the door will be properly hung and to eliminate any gap at the junction where the pair of doors meet along the center of the doorway. The proper aligning of the bearing assemblies is a difficult operation and depends primarily on the skill of the workman. As a result of this, there have been many instances where the traffic doors have not been properly hung, thereby resulting in an incomplete weather seal between the door and the jamb or at the junction between the doors.

SUMMARY OF THE INVENTION

The invention is directed to an improved traffic door. In accordance with the invention, the traffic door is pre-assembled or prehung on a vertically extending rail that is offset from the plane of the door. At the time of installation, the rail is plumbed and welded to the doorway.

The use of the pre-hung construction facilitates proper and precise installation of the door.

As the rail is offset from the door, it will not interfere with swinging movement of the door and yet provides a seal between the vertical edge of the door and the jamb of the doorway. As a result, it is not necessary to incorporate flexible flaps between the door and the jamb as have been used with traffic doors in the past.

As the door is pre-assembled to the rail at the plant, the labor cost for installation is substantially reduced. The pre-hanging also insures proper alignment of the door within the doorway and insures a complete weather seal between the doors.

The traffic door assembly of the invention also includes an upper flexible trim panel which is attached to the horizontal section of the frame. The trim panel can be trimmed to size at the time of installation to fit the doorway. The use of the trim panel enables the door to be utilized with doorways of different heights. This constitutes a distinct advantage over traffic doors as used in the past, in that the prior doors were made to standard doorway heights, and if the doorway was not of standard height, it was necessary to custom build the door.

As an additional feature of the invention, the horizontal frame section of the door is provided with opposed horizontal grooves. The grooves constitute gripping grooves to be engaged by a hook attachment carried by a fork lift truck so that the door can be held in the upright position by the fork lift truck during installation. Prior types of traffic doors had no facility for engagement by a hook or other lifting equipment, so that it was necessary to manually hold the door in an upright position during installation.

The traffic door of the invention also includes an improved manner of connecting the flexible impact resistant panel to the frame. Both the horizontal and vertical frame sections are provided with a pair of spaced fins and the door panel is inserted between the fins and connected thereto by rivets or other fasteners.

Various types of door panels can be utilized with the traffic door assembly of the invention, depending upon the specific installation. Panels can include opaque impact resistant panels, transparent plastic panels, double insulated transparent panels, and the like.

Other objects and advantages will appear in the course of the following description.

DESCRIPTION OF THE DRAWINGS

The drawings illustrate the best mode presently contemplated of carrying out the invention.

In the drawings:

FIG. 3 is a fragmentary front view of the lower end of the door, with parts broken away in section;

FIG. 4 is a horizontal section taken along line 4—4 of FIG. 1;

FIG. 5 is a horizontal section taken along line 5—5 of FIG. 1; and

FIG. 6 is a section taken along line 6—6 of FIG. 1 and showing the attachment of the trim panel to the upper frame section.

DESCRIPTION OF THE PREFERRED EMBODIMENT

Figure 1:
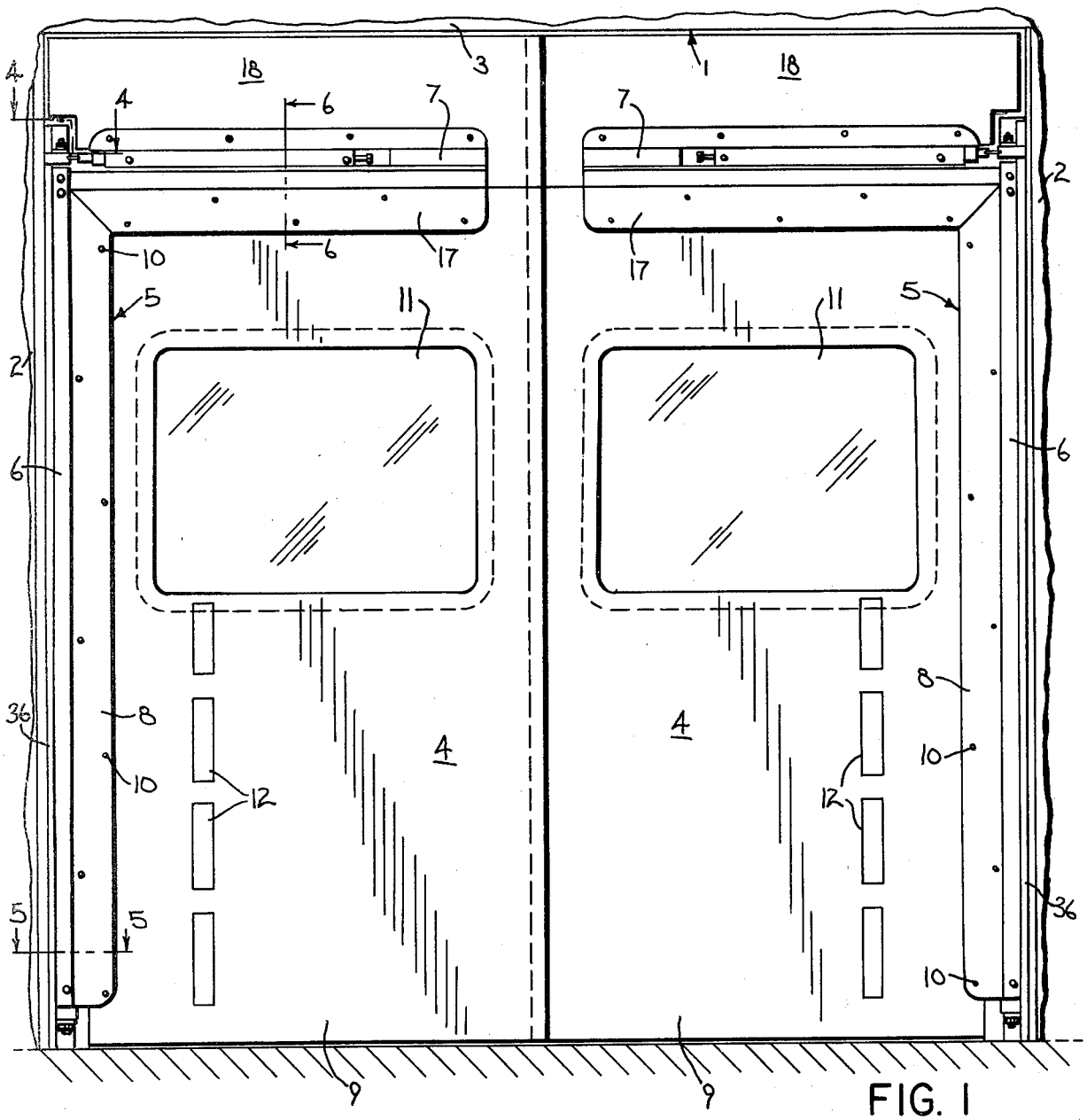
FIG. 1 is a front view of a pair of traffic doors of the invention as installed in a doorway.
Figure 2:
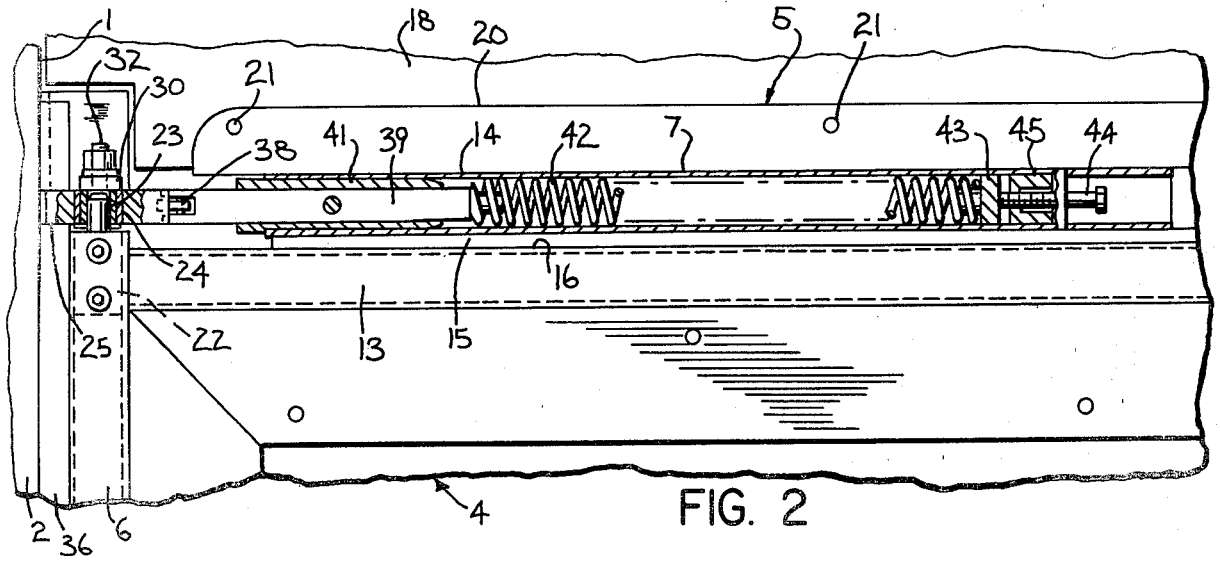
FIG. 2 is a vertical section showing the upper frame section of the door.

FIG. 1 illustrates a doorway 1 in a commercial or industrial building defined by a pair of vertical jambs 2 and a horizontal header 3. A pair of traffic doors 4 are mounted in the doorway 1 to swing in either direction from a closed position. Each traffic door 4 includes an inverted L-shaped frame 5 composed of a vertical frame section 6 and an upper horizontal frame section 7. As best shown in FIG. 5, the vertical frame section 6 has a box-shaped cross section and is provided with a pair of outwardly extending spaced fins 8 which receive the peripheral edge of an impact resistant flexible panel 9. The peripheral edge of the panel is secured between the fins 8 by rivets 10 or other fasteners.

The panel 9 is preferably formed of an impact resistant, rubber-like material which can withstand the impact of material handling equipment, such as fork lift trucks. The panel 9 may be provided with a transparent window 11 and can also include a series of bumpers 12.

The horizontal frame section 7 is composed of an upper rail 13 and a lower rail 14 which are connected by a central bar 15. As best illustrated in FIG. 6, the bar 15 has a lesser width than the rails 13 and 14, thereby providing a pair of longitudinal grooves 16 in the opposite sides of the frame section 7. The grooves 16 extend the entire length of the horizontal frame section and provide gripping areas for a hook or other lifting equipment. With the hook engaged within the groove 16, the traffic door can be lifted and held in an upright position during installation in the doorway.

As in the case of the vertical frame section 6, the lower rail 14 of the upper frame section 7 is provided with a pair of spaced parallel fins 17 which receive the upper edge of the panel 9 and the panel is retained between the fins by rivets or fasteners 10.

In order to accommodate doorways of varying heights, a removable upper trim panel 18 is incorporated with the traffic door. To secure the trim panel 18 to the upper horizontal frame section 7, the upper rail 13 is provided with a single fin 19, and the panel 18 is secured between fin 19 and a plate 20 by rivets 21. After installation of the traffic door 4 in the doorway 1, the trim panel 18 can be trimmed to the desired size to fit the height of the doorway and can then be connected to the fin 19 through use of the rivets 21 or other fasteners.

The door 4 is adapted to be swung between closed and open positions and to provide this swinging action, a block 22 is secured within the open upper end of the vertical frame section 6 and the upper end of the block carries a pivot pin 23. Pivot pin 23 is journalled within a bearing assembly 24 which is mounted within bearing support 25.

The lower end of the door 4 is mounted in a similar manner. Block 26 is secured within the lower open end of the vertical frame section 6 and carries a downwardly extending pin 27 which is journalled within the spherical self-aligning bearing assembly 28 mounted in bearing support 29. Through this construction the door 4 can swing about the axis of the pivot pins 23 and 27.

Bearing supports 25 and 29 are secured to bearing plates 30 and 31 respectively, by bolts 32 and 33. Blocks 34 and 35 are connected to the central portion of bearing plates 30 and 31, respectively, and the blocks in turn are welded to the respective ends of a vertical rail or stile 36. In this manner, the rail 36, blocks 34 and 35, and the bearing assemblies constitute an integral fixed structure.

The traffic door 4 is assembled to the rail 36 at the factory, and this insures precise alignment of the upper and lower bearings. When installed at the location of use, the rail 36 is plumbed within the doorway 1, and the rail, as well as the blocks 34 and 35 are welded to the jamb 2, as shown in FIG. 5.

The traffic door 4 is biased to the closed position by a cam mechanism which is similar to that utilized in U.S. Pat. Nos. 3,295,589 and 4,064,924. In this regard, the outer surface of support 25 defines a generally heart-shaped cam 37 and a follower 38, which is mounted for rotation on the end of a rod 39, rides on the cam surface 40.

The rod 39 is mounted for sliding movement within a sleeve 41 that is mounted within the end of the upper rail 14. A spring 42 is interposed between the end of the rod 39 and a spring seat 43 and acts to bias the follower 38 into engagement with the cam surface 40. The force of the spring can be adjusted by means of an adjusting screw 44 which is threaded within a cup 45 mounted in upper rail 14, and the inner end of the adjusting screw bears against the outer surface of the spring seat 43. Thus, by threaded adjustment of the screw 43, the biasing force on the cam follower 18 can be varied.

The end of the upper rail 14 is provided with a slot to provide access to the adjusting screw 43.

As the door 4 is swung to the open position, either manually or by engagement with mechanical handling equipment, the follower 38 will ride on one of the lobes of the cam surface 40. When the force on the door is released, the force of the spring 42 acting on the cam follower 38 will move the follower along the cam surface of the lobe and return the follower to the central notch 46 in the cam. Thus, the spring 42 acts to bias the door 4 to the closed position, as shown in FIG. 4.

The pre-assembly of the door to the rail 36 at the factory has distinct advantages. The pre-assembly substantially reduces the on-site labor cost for installation and also achieves proper alignment of the door within the doorway, insuring a complete weather seal.

The use of the gripping grooves 16 enables material handling equipment to lift and hold the door in an upright position at the time of installation. This again acts to reduce the labor cost of installation.

As the rail 36 is offset from the plane of the door, and is located in a corner-to-corner relation with the vertical frame section 6, the rail will not interfere with swinging movement of the door, and yet the rail seals the gap between the frame section 6 and the jamb 2. As the gap along the jamb is closed off, it is not necessary to utilize flexible flaps to seal this gap, as employed with traffic doors in the past.

Various modes of carrying out the invention are contemplated as being within the scope of the following claims particularly pointing out and distinctly claiming the subject matter which is regarded as the invention.

I claim:

1. A pre-assembled door assembly, comprising a vertical rail structure, and a door mounted for swinging movement on said rail structure, said rail structure including a vertical rail member to be secured to the jamb of the doorway and being offset from the plane of said door, said rail structure also including a pair of spaced bearings located at the upper and lower ends of said vertical rail member respectively, said door comprising a frame including a generally vertical frame section and an upper horizontal frame section, and a panel supported by said frame, said vertical rail member extending substantially the full height of said door and being disposed in a generally line contact with said vertical frame section, whereby said vertical rail member will not interfere with swinging movement of the door and will seal the gap between the vertical frame section and the doorway jamb.

2. The door assembly of claim 1, wherein both said vertical rail member and said vertical frame section are rectangular in cross section and said vertical rail member and said vertical frame section are disposed in corner-to-corner relation when the door is in the closed position.

3. The traffic door assembly of claim 1, and including a pair of spaced generally parallel fins extending outwardly from said vertical frame section in a direction away from said jamb, said door including an impact resistant panel secured between said fins.

4. The traffic door of claim 1, wherein said assembly also includes an upper trim panel connected to the upper edge of the horizontal frame section, said trim panel being of flexible material and extending upwardly from said horizontal section.

5. The traffic door assembly of claim 4, and including a single fin extending upwardly from said horizontal frame section, a plate disposed parallel to said fin, said trim panel being disposed between said fin and said plate, and means for connecting the plate to said fin to thereby secure the trim panel to the horizontal frame section.

6. The door assembly of claim 1, wherein said horizontal frame section is provided with longitudinally extending grooves in opposite sides thereof, said grooves being adapted to receive lifting equipment to thereby maintain the door in an upright position during installation.

7. The traffic door assembly of claim 6, wherein said horizontal frame section includes an upper beam, a lower horizontal beam and a bar disposed between said upper and lower beams, said bar having a smaller horizontal dimension than said upper and lower beams to thereby define said grooves in opposite sides of the horizontal frame section.

8. A building construction, comprising a wall having a doorway, said doorway being defined by a vertical jamb and a horizontal header, a traffic door assembly disposed within the doorway, said traffic door assembly including a vertical rail structure including a generally vertical rail member secured to the jamb and extending substantially the full height of the jamb, said door assembly also including a door having an inverted L-shaped frame including a generally vertical frame section and an upper horizontal frame section, said door also having a flexible impact resistant panel supported by the frame, means for mounting the door for swinging movement with respect to said vertical rail member about a pivot axis disposed within the plane of the door and offset from said vertical rail member, said vertical rail member and said vertical frame section being disposed in a substantial line contact whereby said vertical rail member will not interfere with swinging movement of the door and will seal the gap between the vertical frame member and the jamb when the door is in the closed position.

9. The building construction of claim 8, wherein both said vertical rail member and said vertical frame section have a generally rectangular cross section and said vertical rail member and said vertical frame section are disposed in corner-to-corner relation.

10. The building construction of claim 9, wherein said pivot axis is disposed centrally of the vertical frame section.

11. The building construction of claim 10, wherein both said vertical frame section and said horizontal frame section are provided with spaced fins, said panel being secured between the respective spaced fins.

12. The building construction of claim 11, and including an upper trim panel connected to the upper edge of the horizontal frame section, said trim panel being composed of flexible material and extending upwardly from said horizontal section to a location adjacent said header.

13. The building construction of claim 12, wherein said horizontal frame section is provided with horizontally extending grooves in opposite faces thereof, said grooves being adapted to be received by a lifting member to hold the door in an upright position during installation.

14. The building construction of claim 8, wherein said means for mounting the door for swinging movement comprises a pair of pivot pins, each pin extending from opposite ends of the vertical frame section, said rail structure including bearing means to receive each of said pins.

* * * * *